United States Patent [19]

Joshi et al.

[11] Patent Number: 5,069,825

[45] Date of Patent: Dec. 3, 1991

[54] DETERGENT LAUNDRY BAR WITH IMPROVED FORMULATION AND PROCESS

[75] Inventors: David P. Joshi, S. Plainfield; P. Ramachandran, W. Windsor, both of N.J.; Zenaida B. Soriano, Alabang, Philippines

[73] Assignee: Colgate-Palmolive Company, Piscataway, N.J.

[21] Appl. No.: 588,540

[22] Filed: Sep. 19, 1990

Related U.S. Application Data

[62] Division of Ser. No. 338,197, Apr. 14, 1989, Pat. No. 5,039,453.

[51] Int. Cl.[5] ..... C11D 1/22; C11D 3/065

[52] U.S. Cl. ..... 252/533; 252/135; 252/174.25; 252/531; 252/558

[58] Field of Search ..... 252/135, 174.25, 531, 252/534, 558, DIG. 16

[56] References Cited

U.S. PATENT DOCUMENTS 4,543,204 9/1985 Gervasio ..... 252/DIG. 16

FOREIGN PATENT DOCUMENTS 2189255 3/1987 United Kingdom .

*Primary Examiner*—Paul Lieberman
*Assistant Examiner*—Alexander G. Ghyka
*Attorney, Agent, or Firm*—Robert Sullivan; Murray Grill; Richard Ancel

[57] ABSTRACT

Detergent laundry bars which are mild to the hands of the user, have good foaming and use up properties during hand washing of laundry and good processing characteristics preferably including a water soluble salt of an alkylbenzene sulfonate, coco fatty acid sulfate paste. Also within the invention is the process for manufacturing the detergent bars.

1 Claim, No Drawings

DETERGENT LAUNDRY BAR WITH IMPROVED FORMULATION AND PROCESS

This application is a division of application Ser. No. 338,197, filed Apr. 14, 1989, now U.S. Pat. No. 5,039,453.

FIELD OF THE INVENTION

The invention relates to a stable synthetic detergent bar composition exhibiting a slow use up rate, ease of processing, smooth bar texture and physical hardness and desirable detergency in both hard and soft water.

SUMMARY OF THE INVENTION

An object of the invention is to provide a synthetic detergent laundry bar having excellent detergency, slow use rate, smooth texture and physical hardness which is easily processed.

Another object of this invention is to provide a unique manufacturing procedure which produces a synthetic laundry bar with excellent physical hardness and texture.

BACKGROUND OF THE INVENTION

Soap bars have been employed in washing a human body and doing laundry for some time. Before the advent of washing machines which dictated the employment of a detergent material and powder, disintergratable bricket or liquid forms, laundry was washed with "laundry soap" bars made from suitable soaps of higher fatty acids such as sodium soap of mixed tallow and rosin fatty acids. Such laundry soap bars were especially suitable for rubbing onto badly stained or soiled portions of fabrics being laundered, as on a wash board, to deposit a high concentration of soap on the soiled area and then providing a mechanical means for applying energy to said surfaces to assist in removing the stains and soils.

Despite the fact that after the introduction of synthetic organic detergents and washing machines, the amount of soap employed for laundry use diminished greatly, with soap based laundry bar being replaced mostly by synthetic organic detergent compositions in powder, liquid or other suitable forms, laundry soap and detergents in bar forms are still preferred by some consumers, especially in certain areas of the world.

Several detergent laundry bars based on alkyl benzene sulfonate detergents have been successfully marketed. They have been characterized as the equivalent in detersive action of powdered laundry detergent based on similar alkyl benzene sulfonates and are considered by many consumers to be more convenient to use. To use them does not require a washing machine as previously indicated, the bar form of the product allows it to be used in such a manner that a comparatively high concentration of detersive material may be readily applied to a heavily stained soiled area with accompanying physical force or energy as on a wash board so as to readily loosen and remove soil or stain.

When the sodium alkyl benzene sulfonate is partially or fully substituted with coco fatty alcohol sulfate as the required surfactant in a detergent laundry bar formulation, the resulting product is deficient in physical hardness during processing, is brittle upon aging and is used up faster during washing by hand.

One solution to the breakage problem is disclosed in U.S. Pat. No. 4,543,204 which teaches the incorporation of higher fatty acids into a bar formula to counteract the tendency of higher fatty acids alcohol sulfate laundry bars to crack or break during storage and shipment and. also mentions the fact that fatty acids improves the foaming characteristics of the fatty acid alcohol sulfate bars. However, that requires the addition of a material to the formula which is not a detergent or builder and which is comparatively expensive. The present invention is of a detergent laundry bar of acceptable laundry bar properties which is environmentally acceptable biodegradable, and does not crack or break to an excessive extent while being stored or in shipment.

DETAILED DESCRIPTION OF THE INVENTION

The problems of the cracking and aging have been overcome by tying up the free moisture by addition of a zeolite and optionally by silicate solution to the formulation. The preferred percentages of zeolite is 1–5%, most preferably 2–2.5% and the silicate 0–3%, preferably 0.2–1.7% by weight of the formulation. The addition of ingredients in the crutcher or amalgamator is also changed to allow the addition of zeolite and tetrasodium pyrophosphate and the hydration of zeolite and tetrasodium pyrophosphate. This also eliminates the possibility of excessive heat and overflow of the overheated material due to the rapid exothermic reaction of the sulfonate acid with sodium carbonate additions which is now held back until the other ingredients are well mixed. Also the coco fatty alcohol sulfate paste is introduced after neutralization to eliminate any chance of hydrolysis or degradation which might result if it was added earlier. Silicate solutions are added after neutralization as well in order to further carry out its moisture binding and plasticizing functions and to avoid lump formation. The resultant mixture processes through subsequent steps smoothly and when extruded through the extruders provide a smooth hard bar (a Dietert hardness of 78 to 83 compared to 72 to 75 for bars without these ingredients) which stay hard are not brittle upon aging and have lower abrasion rates than conventionally produced bars.

Preferable surface active components may include alkyl aryl sulfonates, fatty alcohol sulfates, ethoxylated fatty alcohol sulfates, methyl esters, and mixtures thereof.

Preferably the surface active composition include sulfonated $C_7$–$C_{18}$ alkyl benzene sulfonates alone or mixed with about 17:3 to about 1:4 of sodium fatty acids $C_4$–$C_{18}$ fatty alcohol sulfates.

Suitable aryl sulfonates are alkyl benzene sulfonates including those in which the alkyl group is of straight or branched chain configuration and contains from about nine to about 18 carbon atoms. Some of the more readily available compounds include the following: sodium decyl benzene sulfonate, sodium dodecyl benzene sulfonate, sodium tridecyl benzene sulfonate, and sodium hexadecyl benzene sulfonate. The alkyl benzene sulfonate preferably has a branched alkyl chain and is in the form of a liquid of 96% by weight minimum purity. The content of alkyl aryl sulfonate will be in the range of 0 to 50%, preferably 5–35%, most preferably 20–30% by weight of the laundry bar composition. When the alkylaryl sulfonate is mixed with additional surface active agent it preferably constitutes about 10–85% by total weight of the surface active weights of the detergent bars.

The most useful sulfated alcohols are derived from higher alkyl fatty alcohols having the general formula $R—CH_2—OS_3ONA$ where R is an alkyl group containing nine to 18 carbon atoms. The content of fatty alcohol sulfonate will be in the range of 0 to 50%, preferably 5–35%, most preferably 5–20% by weight of the laundry bar composition. Highly desirable detergency is obtained when the hydrophobic carbon chain length of the alkyl sulfate contains 12 to 18 carbon atoms, regardless of whether natural fatty acids or synthetic alcohols such as oxoalcohols are used. The preferred alcohol sulfate for use in this invention is coco fatty alcohol sulfate typically having a white cream to heavy paste consistency having a minimum purity of 60% by weight. Preferably the fatty alcohol sulfate constitutes 15–70% by weight of the total surface active ingredient in this synthetic detergent cleaning bar.

Also included are higher fatty alcohol ethoxylate sulfates among possible surfactants. It is preferably of a fatty alcohol which is essentially saturated and of a carbon atom chain length within the 10 to 18 carbon atoms range, often more preferably of 12 to 16 or 12 to 15 carbon atoms. The ethoxy chain of the ethoxylate sulfate may be of 1 to 20 ethoxy group(s), preferably being of 3 to 8 ethoxy groups, and more preferably it is of about 3 ethoxy group(s). The range of this ingredient is 0–50% by weight.

The alpha-sulpho methyl esters most preferred for use in this synthetic detergent cleaning bar are derived from coconut oil, with a coco-methyl ester having less than 2% by weight of its alkyl group having a chain length of $C_{10}$ or less, and having less than 2% by weight iodine value. The coco methyl ester feed stock may be derived from other sources comprising alkyl group having 12–18 carbon atoms. The content of alpha-sulfo methyl ester will be 0–50%, preferably 5–35% by weight of the laundry bar composition.

One of the essential features of the instant invention is the addition of 1–5% by weight zeolite and 0.2–3.0% by weight sodium silicate in the formulation. Any water soluble silicate can be used, preferably a sodium silicate having a 1:2.4 $Na_2O$: $SIO_2$ ratio. It has been found that the addition of the zeolite and sodium silicate in the present invention provides the bar with excellent detergency and texture and hardness properties. The zeolite is preferably added as a powder with 90% of the powder having a particular size distribution of 1–4 microns. The preferred zeolite for use in this synthetic detergent bar composition is zeolite A, preferably zeolite 4A. Zeolite A comprises a three dimensional network of SiO4 tetrahedra crosslengths by sharing of oxygen atoms; the formula may be written as follows: $Na_{12}$-$(AlO_2SiO_2)XH_2O$ where X is an integral between 20–30 preferably 27.

The filler materials for use in the composition include calcium carbonate, soda ash, and mixtures thereof. The filler may also be selected from talc, sodium sulfate, clay and starch. The total filler content is typically up to 60% preferably 20–40% of the synthetic detergent bar. Magnesium sulfate is preferred as it adds detergent cleansing bars hardness.

The formulation also contains between 5–50%, preferably 5–15 mostly preferably 9.6% tetrasodium pyrophosphate builder. Various water soluble builder salts, usually as sodium salts, may be incorporated in the invented laundry bars. Of these the most important are the phosphates, particularly the polyphosphates, such as sodium tripolyphosphate and sodium pyrophosphate. Sodium orthophosphate may be employed, usually in minor proportion with respect to the polyphosphate(s). Other builder salts, of the chelating or precipitating types, inorganic and organic, may also be used, such as sodium carbonate, sodium silicate, normally of $Na_2O$:-$SiO_2$ ratio in the range of 1:1.6 to 1:3, preferably 1:2 to 1:3, and more preferably 1:2 to 1 2.4, borax, and sodium bicarbonate. Other builders, including organic builders, such as trisodum nitrilotriacetate (NTA), sodium polyacrylate, sodium citrate and sodium polyacctal carboxylate may be used, as may be other water soluble salts of the corresponding acids.

A synthetic detergent bar typically comprises 2–2.5% by weight zeolite 4A about 0.2–1.7% by weight of sodium silicate about 25% by weight $C_9$–$C_{18}$ branch alkyl benzene sulfonate and about 7–10% by weight coco fatty alcohol sulfate paste.

The builder and filler surface active agents may be admixed with other ingredients such as brighteners, bleaching agents, whitening agents, antioxidants, bactericides, fungicides, dyes/pigments, anti-redeposition agents, for example carboxymethyl cellulose and other polymers, perfume, opacifier, and a small quantity of water. In addition various other functional ingredients some of which may improve the synthetic detergent bars mildness to the skin may be incorporated into the detergent bar as desired. Examples are: cocodiethanolamide, glycerin, lanolin and other moisturizers typically about 0.1–5% by weight each.

It has also been discovered that the hardness and texture qualities of the detergent bar can be greatly enhanced by using particular processing methods in accordance with an aspect of this invention. The particular method, comprises addition of the zeolite, and sodium pyrophosphate and magnesium sulfate into the liquid material prior to the addition of the sodium carbonate neutralizing agent. This allows some neutralization of the sulfonic acid base with magnesium sulfate and tetrasodium pyrophosphate and hydration of zeolite and tetrasodium pyrophosphate. This also eliminates the possibility of excess heat and overflow of the aerated material due to the rapid gas producting exothermal reaction of sulfonic acid and sodium carbonate additions. The sodium carbonate additions are held back until after the other ingredients are well mixed. In addition the coco fatty acids sulfate paste is introduced after the neutralization so as to eliminate any chance of hydrolysis and degradation which might result if added earlier. The silicate solution is added after the neutralization in order to carry out its moisture binding and plasticizing function thus providing a smooth mixture without lumps. The resultant mixture processes through subsequent steps smoothly and when extruded through the extruder provides a smooth hard bar (Dietert hardness of 78–83 compared to 72–75 bars without these ingredients). The bars are hard and not brittle upon aging and have lower use-up rates than conventionally produced bars.

ILLUSTRATIVE EXAMPLES OF THE INVENTION

The following examples are given to further illustrate the invention. All proportions and amounts are by weight unless otherwise indicated.

EXAMPLE 1

Composition is prepared having the following formulation.

| Ingredients | Part |
|---|---|
| $C_9$—$C_{18}$ alkyl benzene sulfonate | 25.5 |
| Magnesium sulfate (25% solution) | 2.9 |
| Sodium carbonate | 14.4 |
| Tetrasodium pyrophosphate | 9.6 |
| Calcium carbonate | 17.3 |
| Coco fatty alcohol sulfate paste(70% purity) | 9.2 |
| Calcium carbonate | 19.1 |
| Opacifier, coloring agent, perfume | 1.7 |
| Minor amount of water | |

The synthetic detergent bar is prepared by mixing the above ingredients in the order shown in amalgamator mixer of counter rotation sigma blades. The mixer is equipped with a refrigeration unit which is set to give a chilled water temperature of 10°-15° C. The ambient temperature is about 30°-40° C. The batch is subsequently milled into chips under vacuum then extruded into bars. This example is the control for comparison to the other examples 2 and 3. These bars had a Dietert hardness of 72-75.

EXAMPLE 2

Detergent bars are prepared having the following formulations.

| Ingredient | Parts |
|---|---|
| $C_9$—$C_{18}$ alkyl benzene sulfonate | 25.5 |
| Magnesium sulfate (25% solution) | 2.9 |
| Zeolite | 2.5 |
| Tetrasodium pyrophosphate | 9.6 |
| Sodium carbonate | 14.4 |
| Calcium carbonate | 17.3 |
| Coco fatty alcohol sulfate paste | 9.2 |
| Calcium carbonate | 17.0 |
| Opacifier, coloring agent perfume | 1.7 |
| Minor amount of water | |

EXAMPLE 3

| Ingredient | Parts |
|---|---|
| $C_9$—$C_{18}$ alkyl benzene sulfonate | 25.5 |
| Magnesium sulfate (25% solution) | 2.9 |
| Zeolite | 2.0 |

-continued

| Ingredient | Parts |
|---|---|
| Tetrasodium pyrophosphate | 9.6 |
| Sodium carbonate | 14.4 |
| Calcium carbonate | 17.3 |
| Coco fatty alcohol sulfate paste (70% purity) | 9.2 |
| Sodium silicate (44% solution) | 0.5 |
| Calcium carbonate | 17.0 |
| Opacifier, coloring agent perfume | 1.7 |

The bars were formed using the same techniques as described in Example 1. The bars had a Dietert hardness of 78-83.

It is apparent from these data the addition of the zeolite and silicate to the formulation greatly improves the hardness of the product.

Obviously many modifications and variations of the invention may be made without departing from the essence and scope thereof and only such limitations can be applied as indicated in the appended claims.

What is claimed is:

1. A process for manufacturing a milled and plodded detergent bar characterized by a Dietert hardness of 78-83 and a slow use up rate comprising the steps of:

(a) adding a quantity of a $C_9$ to $C_{18}$ alkyl benzene sulfonate equal to about 15 to 30 percent by weight of the final bar to a crutcher or amalgamator, (b) adding a quantity of sodium pyrosulfate equal to about 5 to 10 percent of the weight of the final bar, a quantity of sodium exchanged zeolite equal to about 2 to 2.5 percent by weight of the final bar, and a quantity of magnesium sulfate equal to about 2 to 4 percent by weight of the final bar, to the crutcher or amalgamator, (c) stirring the resultant mixture to effect partial neutralization, (d) adding a quantity of sodium carbonate equal to about 10 to 15 percent of the weight of the final bar to the mixture with stirring to complete neutralization of the mixture, (e) adding a quantity of coco fatty alcohol sulfate equal to about 8 to 15 percent by weight of the final bar and a quantity of sodium silicate equal to about 0.2 to 1.7 percent by weight of the final bar to the mixture, (f) mixing the ingredients, plodding the mixture thus formed under vacuum, (g) extruding to form a homogeneous bar.

* * * * *